US007387688B2

(12) United States Patent
Jung et al.

(10) Patent No.: US 7,387,688 B2
(45) **Date of Patent: *Jun. 17, 2008**

(54) METHOD OF OPERATING A DISHWASHER WITH A CENTRAL CONTROL UNIT BY MEASURING THE TURBIDITY

(75) Inventors: Clemens Jung, Bruecken (DE); Peter Schwarzweller, St. Wendel (DE); Konrad Petry, Mandelbachteil (DE); Reinhold Baltes, Roschberg (DE)

(73) Assignee: Whirlpool Corporation, Benton Harbor, MI (US)

( * ) Notice: Subject to any disclaimer, the term of this patent is extended or adjusted under 35 U.S.C. 154(b) by 198 days.

This patent is subject to a terminal disclaimer.

(21) Appl. No.: 10/713,305

(22) Filed: Nov. 14, 2003

(65) Prior Publication Data

US 2004/0111807 A1 Jun. 17, 2004

(30) Foreign Application Priority Data

Nov. 14, 2002 (DE) ..... 102 53 025

(51) Int. Cl.
*B08B 7/04* (2006.01)
*B08B 9/20* (2006.01)
*B08B 3/00* (2006.01)

(52) U.S. Cl. ..... 134/18; 134/25.2; 134/36; 134/113

(58) Field of Classification Search ..... 134/18, 134/25.2, 36, 113
See application file for complete search history.

(56) References Cited

U.S. PATENT DOCUMENTS 3,888,269 A * 6/1975 Bashark ..... 134/57 D
5,560,060 A 10/1996 Dausch et al.
5,586,567 A * 12/1996 Smith et al. ..... 134/57 D
5,960,804 A 10/1999 Cooper et al.
6,432,216 B1 * 8/2002 Thies ..... 134/18
2004/0163679 A1 * 8/2004 Jung et al. ..... 134/25.2

FOREIGN PATENT DOCUMENTS

DE 19651344 A1 6/1998
DE 10057210 A1 5/2003
EP 1029962 A1 8/2000

OTHER PUBLICATIONS

The documents listed hereinabove were cited in the European Search Report EP 03025906.3 dated Oct. 5, 2005 received in connection with a European Application corresponding to the above-referenced U.S. application.

* cited by examiner

*Primary Examiner*—Michael Barr
*Assistant Examiner*—Rita R Patel
(74) *Attorney, Agent, or Firm*—John Morrison; Michael D. LaFrenz

(57) ABSTRACT

The invention relates to a method of operating a dishwasher with a central control unit by measuring the turbidity of the rinsing liquid and establishing the course of the program as a function of the turbidity of the rinsing liquid, the program beginning with a pre-rinse program step. In order to achieve a completely automatic operation, data for the further course of the program are calculated in the pre-rinse program portion with determined measurement values of turbidity and evaluation thereof.

19 Claims, 3 Drawing Sheets

METHOD OF OPERATING A DISHWASHER WITH A CENTRAL CONTROL UNIT BY MEASURING THE TURBIDITY

BACKGROUND OF THE INVENTION

1. Field of the Invention

The invention relates to a method for operating a dishwasher with a central control unit by measuring the turbidity of the rinsing liquid and establishing the course of the program as a function of the turbidity of the rinsing liquid, the program beginning with a pre-rinse program step.

2. Description of the Related Art

Dishwashers currently available on the market normally have a control unit—a program control device—, with which a rinse program, which can be made up of the part program steps "Pre-rinse", "Clean", "Intermediate Rinse", "Rinse" and "Dry", can be operated. For this purpose a number of selection switching means are necessary in order to make it possible for the user to adjust the different rinse programs. This multitude of manually effectable choices does not rule out dishwasher operating errors.

Consequently, there has been no lack of attempts to create a dishwasher where it is totally impossible for the user to make an error, thereby restricting the dishwasher's consumption of power and water to the smallest possible measurement.

Dishwashers have been created where the dishwasher is simply set in motion at the start of the program, and in that parameters to be set for the further course of the rinse program are set as a function of at least one determined parameter, which is necessary to the continuation of the rinsing operation and is influenced by the same. At the same time, in accordance with a specific development of the method, the degree of soiling, i.e. the turbidity of the rinsing liquid, is measured and the rinse program is established as a function of this turbidity in order to guarantee a fully automatic course of the rinse program and consequently to avoid the operator of the dishwasher making an error.

It has been shown that, for the various types and quantities of soiling, no adequate cleaning operation can be achieved in this manner with optimized power and water consumption. The dishes can be soiled a lot or a little and it can be easy or difficult to remove this soiling from the dishes. Only fresh or dried-on or burnt-on soiling can be referred to. In addition, the dishwasher can be loaded in the two spray planes or only in one spray plane.

SUMMARY OF THE INVENTION

It is an object of the invention to provide a method of the aforementioned type with a pre-rinse operation, in which the degree of soiling of the rinsing liquid is used optimally for the further course of the program according to the quantity of soiling and the solubility of the soiling on the dishes in order to adjust the power and water consumption to the given conditions in an optimum manner.

This object is achieved according to the invention in that the turbidity is continuously measured in the pre-rinse program step with the lower and upper spray plane being operated in an alternating manner and the measured turbidity values are associated with the respective spray plane set in operation, in that, in addition, the increase in the turbidity values is detected, in that the length of time until the increase in the turbidity values has achieved the value zero is determined, in that difference values are formed from the respective turbidity values and a degree of soiling of the rinsing liquid, according to quantity of soiling and solubility of the soiling on the dishes, is derived from the turbidity values, the difference values and the length of time, and in that the further course of the rinse program in part program steps is established and accomplished as a function of the determined quantity of soiling and solubility of the soiling on the dishes (identical type of soiling).

Parameters, which provide information on the quantity of soiling and the type of soiling—dirt which is dried-on, burnt-on or easily dissolvable—can be derived in the pre-rinse operation with the two turbidity values determined for the spray planes, by means of the difference values of the turbidity values and the length of time until the increase in the turbidity values achieves the value zero. With the values, determined and derived in this manner, it is not only the pre-rinse operation that can be completed at the correct time and the further course of the program introduced, the further part program sections can also be carried out as a function of the determined and derived soiling values under optimum conditions, which conditions can be optimized according to power and water consumption and shortest clean times.

The deriving of the difference values of the two spray planes is effected, according to a preferred development, in the manner that the increase in the turbidity is measured both with the lower and upper spray plane operating, and that the difference value is derived continuously from the turbidity values of the two spray planes. At the same time, the spray arms of the spray planes in the alternating operating phases are inserted into the circulation circuit of the circulation pump for the rinsing liquid.

The procedure with the measured turbidity values is preferably such that a degree of soiling for the rinsing liquid is derived from the difference value of the turbidity values of the lower and upper spray plane, which degree of soiling is used for establishing the further course of the program.

To minimize the water consumption it can be provided that, up to a preset degree of soiling, the rinsing liquid is retained for the further part program steps, as well as that when the preset degree of soiling is exceeded, the rinsing liquid is changed at least partially, and in that the new or partially supplemented rinsing liquid is used with or without a heating-up operation in the further part program sections. The water consumption is automatically adjusted to the soiled dishes to be cleaned in the dishwasher. The parameters used in this case clearly convey the condition of the soiling, such that part program steps that are not required are avoided and the course of the program can be reduced to what is absolutely necessary. At the same time, the heating for the rinsing water, the addition of cleansing agent and the number of part program steps for Cleaning, Final Rinsing and Drying can also be adjusted and reduced to the measurement necessary for the present soiling situation.

Where the soiling of the dishes is extreme, it can be provided that the pre-rinse operation with the soiling analysis, length of time and/or turbidity values and difference values is repeated at least once with the new or partially supplemented rinsing liquid, with heating of the rinsing liquid in order to dissolve the largest part possible of the soiling on the dishes and to bring it into the rinsing liquid.

The costs of the sensor and evaluation means can be kept down in that one common turbidity sensor is used to detect the turbidity of the rinsing liquid continuously and is associated with the spray arm operating and its spray plane.

The soiling analysis is followed by another sequence, which is characterised in that the pre-rinse operation is completed when no further increase in the turbidity is measured, in that, thereafter, a first soiling analysis is carried out, in that where the soiling is easy to clean, the transition into a part rinsing step Cleaning with No Change of Water is effected, and in that where the soiling requires an average intensity to clean, the pre-rinse operation is continued and the necessary rinse time is calculated via the fuzzy set, after the expiry of this rinse time the water is changed and the part rinsing step Cleaning is carried out, whilst where the soiling requires a high degree of intensity to clean, the rinsing liquid is heated up and the necessary rinse temperature and rinse time is calculated via the fuzzy set, once the temperature of the rinsing liquid is reached and the rinse time has expired, the water is changed and the beginning of the part rinsing step Cleaning is introduced. The rinse operation can be repeated here if the soiling is extensive.

The part rinse step Cleaning, which follows the pre-rinse operation, is characterised in that the soiling of the water is also continuously controlled in the part rinse step Cleaning and the soiling of the water is divided into easy, average or intense soiling steps, in that in the part rinsing step Cleaning the dosing of the cleanser and the heating-up of the rinsing liquid to a minimum temperature is effected, in that rinsing continues until no further increase in the turbidity of the rinsing liquid is ascertained, in that, thereafter, another soiling analysis is carried out, and in that, depending on the intensity of the part rinsing step Cleaning, and as a function of the second soiling analysis, a rinse time and an end temperature for the part rinsing step Cleaning is established via the fuzzy set. If, however, no soiling is detected in the part rinsing step Cleaning, the transition is made to the cleaning operation without the dosing of any cleanser.

At the same time it can be provided, in addition, that the rinse time and the end temperature for the rinsing liquid in the part rinsing step Cleaning is limited in the program memory of the control unit to certain maximum values in order to restrict the power and water consumption to maximum output.

At the end of the part rinse step Cleaning, there is always a change of water before an intermediate rinse operation and a final rinse operation if the soiling in the part rinse step Cleaning has been established as average or high. After the part rinse step Cleaning comes a third soiling analysis if the part rinse step Cleaning has been carried out with a low soiling level. In addition, a change of water for the next part rinse step is then cut out if only the very smallest degree of soiling was measured in the water.

Following the intermediate rinse operation is a fourth soiling analysis, in which the decision is made as to whether or not the rinsing liquid can be used for the final rinse operation or whether the water has to be changed before the final rinse operation.

The intermediate rinse operation takes place according to one development in that an intermediate rinse operation with a minimum rinse time is carried out after the part rinsing step Cleaning, in that at the same time a fifth soiling analysis is carried out, and in that, as a function thereof, the intermediate rinse operation is completed, via the fuzzy set a defined intermediate rinse moment is calculated, a defined intermediate rinse time is established or further intermediate rinsing steps are carried out.

If a filter or shaft requires cleaning, this occurs after the intermediate rinse operation. If, in the soiling analysis, the requirement for a second intermediate rinse operation has been determined, the water is changed between these intermediate rinse operations.

The final rise operation, following the intermediate rinse operation, is characterised in that after the intermediate rinse operation a final rinse operation is carried out, in which the rinsing liquid is heated up to a minimum temperature, a final rinse agent is dosed and the end temperature for the final rinse operation is calculated via the fuzzy set. In this case, the total power consumption for the final rinse operation is limited to a certain measurement.

For the drying operation, which is provided at the end of the rinse program, the development is established in such a manner that a drying operation with a minimum time and a calculated overall drying time is carried out after the final rinse operation. The temperature of the drying phase as a function of the previously effected final rinse phase is selected in this case in such a manner that the drying time is established as a function of the temperature of the final rinsing liquid, a short drying time being selected with a high final rinse temperature and a long drying time being selected with a low final rinse temperature.

BRIEF DESCRIPTION OF THE DRAWINGS

The invention is described in more detail by way of a method exhibited in flow charts. In which.

DETAILED DESCRIPTION

As the arrow underneath the flowcharts shows, stability control is carried out during the entire rinse program when the circulation pump is switched on. At the same time, the pressure of the circulation pump is kept steady, the quantity of foam occurring causing, amongst other things, a change in the quantity of water in the circulating cycle of the circulation pump.

Figure 1:
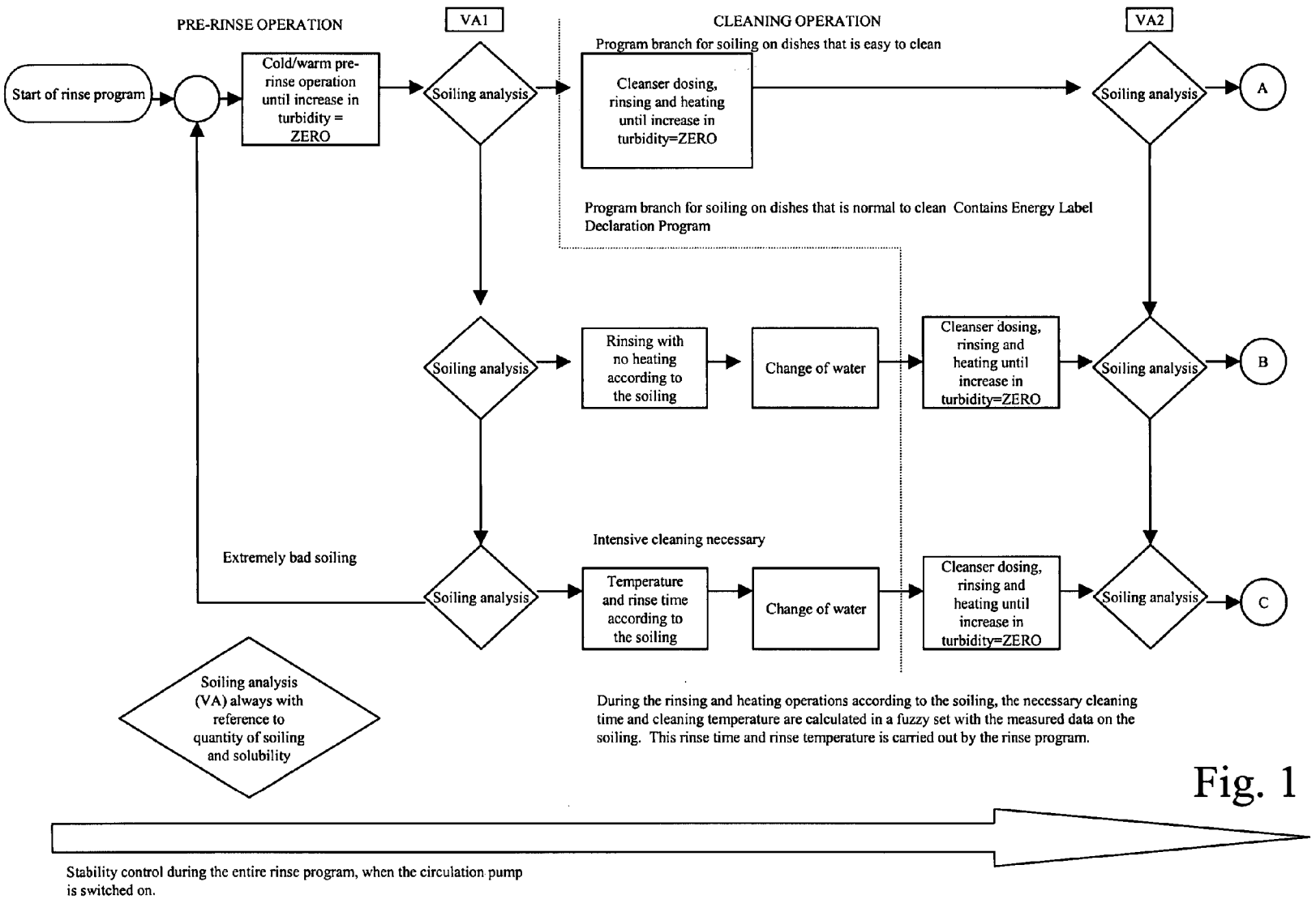
FIG. 1 is the basic course of the program of the method according to the invention.

As the program in FIG. 1 shows, when the dishwasher is switched on, a pre-rinse operation with cold or warm rinsing liquid is introduced and is carried out until the rise, i.e. the increase, in the turbidity curve is zero. A common turbidity sensor with electronic evaluating means is used in this case and the turbidity values are measured for the alternate operation of the upper and lower spray plane and the respective difference values are formed from the two turbidity values. In addition, the length of time from the beginning of the operation of the dishwasher to the point where the increase in the turbidity values achieve the value zero is detected. With these measured values and derived values, various soiling levels of the soiling on the dishes can be deduced and used for program control. This is carried out in a first soiling analysis VA1 after the pre-rinse operation.

Figure 2:
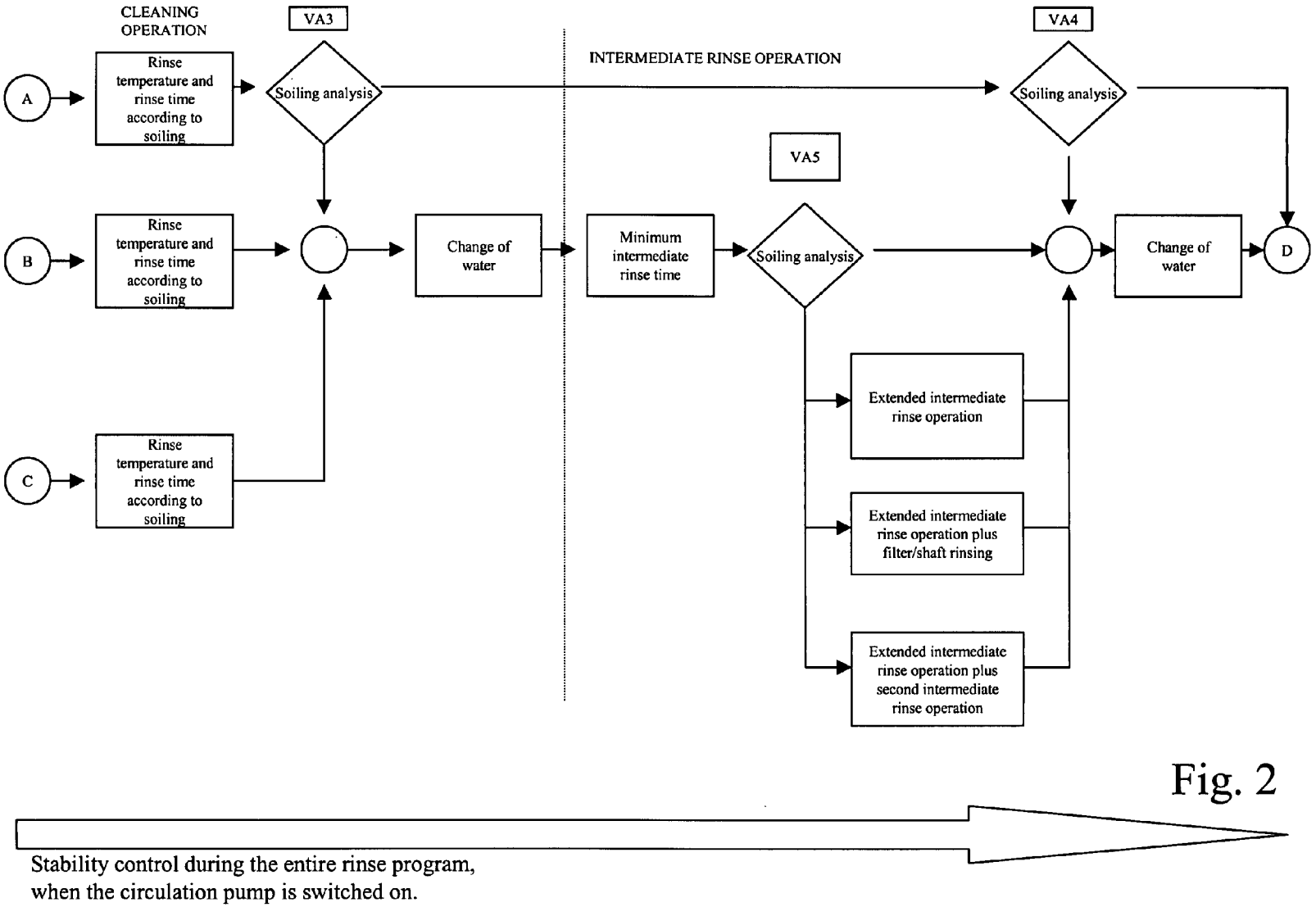
FIG. 2 is the course of the method with an intermediate rinse operation after the cleaning phase and FIG. 3 is the part program steps Final Rinsing and Drying of the dishes, which follow the intermediate rinse operation.

If the soiling is easy to clean, the cleaning operation can then follow the pre-rinse operation, the cleansing agent being dosed and the rinsing liquid heated up. As the output A in the chart in FIG. 1 and the input A in the chart in FIG. 2 show, after the second soiling analysis VA2, the rinse time and rinse temperature for the cleaning operation are established in the control unit via the fuzzy set and at the end of the cleaning operation a third soiling analysis VA3 is carried out, which provides information on the intermediate rinse operation. A fourth soiling analysis VA4 determines whether or not it is necessary to change the water before the final rinse operation. At the same time, the energy consumption in the cleaning operation, the end temperature in the final rinse operation and the drying time for the drying operation are determined. With low energy consumption, the end temperature is higher and the drying time shorter than in the case of previous higher energy consumption.

Figure 3:
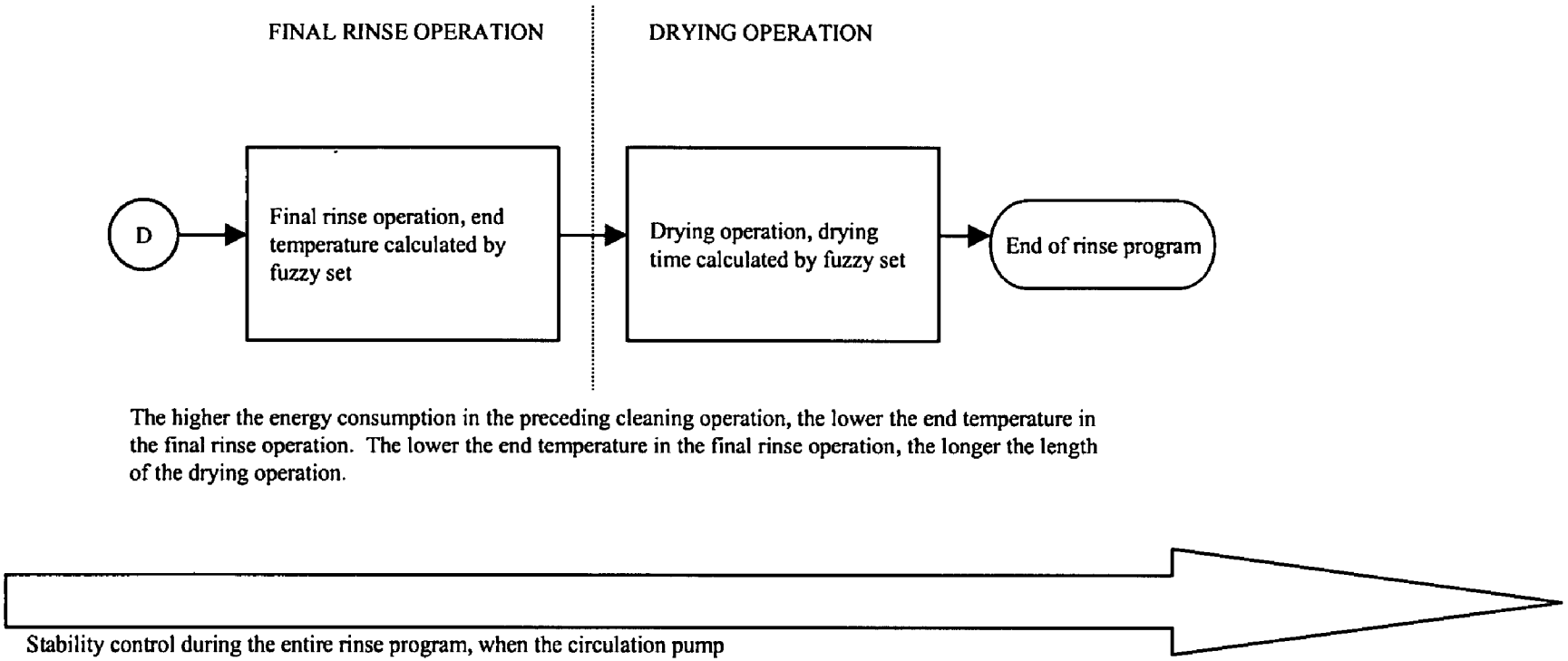

If the first soiling analysis VA1, however, produces a soiling of the dishes to be cleaned normally, the pre-rinse operation is then extended, as a Cleaning with No Heating of the Rinsing Liquid follows the pre-rinse operation, the measured values being considered accordingly. Before the dosing of a cleansing agent, the water is changed and the process is then continued with dosed cleanser and the rinsing liquid heated up until the increase in the turbidity values assume the value zero again. After the second soiling analysis VA2, the program is continued via the output B and the input B with a change of water and an intermediate rinse operation carried out for a minimum length of time. After this intermediate rinse operation, a fifth soiling analysis VA5 is carried out which can result in a direct change of water before the final rinse operation and drying operation, or results, via an inserted extended intermediate rinse operation, an extended intermediate rinse operation with filter and shaft rinse operations or an extended intermediate rinse operation plus a second intermediate rinse operation, in a change of water initially before the final rinse operation and drying operation. This program continuation is a function of the values determined in the fifth soiling analysis VA5, which are always determined in the same way, but are converted by the fuzzy set according to the associated soiling analysis VA5. It must be established once again that the soiling analyses are always undertaken with reference to the quantity of soiling and the solubility of the soiling on the dishes. If the degree of soiling requires an intensive cleaning operation, this is established in the first soiling analysis VA1. The pre-rinse operation can then be repeated, as is shown by the lower branch on the flowchart in FIG. 1. The cleaning operation is carried out with temperature and rinse time, which have been established according to the soiling. After this comes a change of water with subsequent cleanser dosing, rinsing and heating, as for the soiling on the dishes requiring normal cleaning. The further course via the second soiling analysis passes via the correspondingly established rinse temperature and rinse time to the intermediate rinse operation in FIG. 2 and the final rinse operation and drying operation in FIG. 3 (output C, FIG. 1-*Input* C, FIG. 2 and output D, FIG. 2 and input D, FIG. 3).

We claim:

1. A method of cleaning dishes in a dishwasher in accordance with a programmed wash cycle implemented by a central control unit and comprising a rinse step and a cleaning step where a rinsing liquid is recirculated in the dishwasher, the dishwasher comprising an upper spraying apparatus defining an upper spray plane and a lower spraying apparatus defining a lower spray plane, the method comprising:

determining turbidity values corresponding to the recirculation of the rinsing liquid in the lower spray plane and the upper spray plane, respectively, the lower and upper spray planes alternately recirculating the rinsing liquid and the determined turbidity values being associated with the respective spray plane in operation;

determining a degree of soiling by determining a difference value corresponding to the difference between the turbidity values of the upper and lower spray planes; and setting at least one operating parameter of at least one of the rinse step and the cleaning step based on the determined degree of soiling.

2. The method according to claim 1, wherein the determination of the degree of soiling occurs during a pre-rinse step.

3. The method according to claim 2, wherein the pre-rinse step is accomplished initially without heating the rinsing liquid.

4. The method according to claim 2, wherein the pre-rinse step comprises a portion of the rinse step.

5. The method according to claim 1, wherein the setting of the at least one operation parameter comprises setting at least one of a) a number of rinse steps to be performed, b) a duration of a rinse step, c) a water temperature of a rinse step, d) a duration of the cleaning step, e) a time at which dosing the rinsing liquid with a cleaning agent occurs, f) draining and refilling of the rinsing liquid, g) draining of the rinsing liquid, and h) drying time.

6. The method according to claim 1, wherein the determining of the turbidity values corresponds to the turbidity when the turbidity is no longer increasing upon the recirculation of the rinsing liquid in the lower spray plane and the upper spray plane, respectively.

7. The method according to claim 6, wherein the determining of the turbidity values comprises alternately recirculating the rinsing liquid in the lower and upper spray planes until the turbidity stops increasing for both the lower and upper spray planes.

8. The method according to claim 7, and further comprising determining of a length of time for the turbidity to stop increasing for both the lower and upper spray planes.

9. The method according to claim 8, wherein the determination of the length of time required for turbidity of the rinsing liquid to stop increasing, the turbidity values, and the difference value is repeated at least once with a change in and heating of the rinsing liquid.

10. The method according to claim 8, wherein the setting of the at least one operating parameter is based on at least one of the difference value and the length of time for the turbidity to stop increasing.

11. The method according to claim 10, wherein the setting of the at least one operating parameter comprises setting the duration of the rinse step, water temperature of the rinse step, and additional water for the rinse step.

12. The method according to claim 11, wherein the difference value is derived continuously from the turbidity values of the lower and upper spray planes.

13. The method according to claim 1, wherein the turbidity is obtained from a turbidity sensor.

14. The method according to claim 1, wherein the rinsing liquid is categorized based on the determined degree of soiling, and the setting of the at least one operation parameter is based on the categorization.

15. The method according to claim 14, wherein the setting of the at least one operation parameter comprises setting at least one of a) a number of rinse steps to be performed, b) a duration of a rinse step, c) a water temperature of a rinse step, d) a duration of the cleaning step, e) a time at which dosing the rinsing liquid with a cleaning agent occurs, f) draining and refilling of the rinsing liquid, g) draining of the rinsing liquid, and h) drying time.

16. A method of cleaning dishes in a dishwasher in accordance with a programmed wash cycle implemented by a central control unit and comprising a rinse step and a cleaning step where a rinsing liquid is recirculated in the dishwasher, the dishwasher comprising a first and second set of spray nozzles, the method comprising:

alternately operating the first and second set of spray nozzles;

determining a first turbidity value associated with the operation of the first set of spray nozzles;

determining a second turbidity value associated with the operation of the second set of spray nozzles;

determining a degree of soiling of the rinsing liquid based on a difference value corresponding to the difference between the first and second turbidity values; and setting at least one operating parameter of at least one of the rinse step and the cleaning step based on the determined degree of soiling.

17. The method according to claim 16, wherein the determining of the turbidity values corresponds to the turbidity when the turbidity stops increasing during the circulation of the rinsing liquid in the first set of spray nozzles and the second set of spray nozzles, respectively.

18. The method according to claim 17, further comprising:

determining a length of time for the turbidity to stop increasing for the first and second set of spray nozzles, the setting of the at least one operating parameter being based on at least one of the difference value and the length of time for the turbidity to stop increasing.

19. The method according to claim 17 further comprising determining a length of time required for turbidity of the rinsing liquid to stop increasing for the first and second set of spray nozzles, the determination of the length of time required for turbidity of the rinsing liquid to stop increasing, the turbidity values, and the difference value being repeated at least once with a change in and heating of the rinsing liquid.

* * * * *